US006589028B1

(12) United States Patent
Eckerbom et al.

(10) Patent No.: US 6,589,028 B1
(45) Date of Patent: Jul. 8, 2003

(54) DIAPHRAGM PUMP

(75) Inventors: Anders Eckerbom, Vaxholm (SE); Christian Stahnke, Solna (SE)

(73) Assignee: Artema Medical AB, Sundbyberg (SE)

( * ) Notice: Subject to any disclaimer, the term of this patent is extended or adjusted under 35 U.S.C. 154(b) by 0 days.

(21) Appl. No.: 09/890,582

(22) PCT Filed: Jan. 20, 2000

(86) PCT No.: PCT/SE00/00112

§ 371 (c)(1),
(2), (4) Date: Oct. 30, 2001

(87) PCT Pub. No.: WO00/46505

PCT Pub. Date: Aug. 10, 2000

(30) Foreign Application Priority Data

Feb. 2, 1999 (SE) ..... 9900350

(51) Int. Cl.[7] ..... F04B 17/00; F04B 23/04
(52) U.S. Cl. ..... 417/413.1; 417/521
(58) Field of Search ..... 417/413.1, 559, 417/521, 569

(56) References Cited

U.S. PATENT DOCUMENTS 2,228,714 A 1/1941 Wiltse
3,642,385 A * 2/1972 McMahon ..... 417/411
3,784,334 A 1/1974 Hilgert
4,170,439 A * 10/1979 Hase ..... 417/413.1
5,052,904 A * 10/1991 Itakura et al. ..... 417/363
5,106,274 A 4/1992 Holtzapple
5,246,353 A * 9/1993 Sohn ..... 417/413.1
5,669,762 A * 9/1997 Lee ..... 417/312
5,730,587 A * 3/1998 Snyder et al. ..... 417/413.1

FOREIGN PATENT DOCUMENTS

DE 196 38 722 4/1998

* cited by examiner

*Primary Examiner*—Charles G. Freay
*Assistant Examiner*—Timothy P. Solak
(74) *Attorney, Agent, or Firm*—Young & Thompson

(57) ABSTRACT

A diaphragm pump includes a pump housing having an inlet and an outlet for the fluid. The pump housing (2) includes a partition wall (4) which delimits two chambers (3) on a respective side of the partition wall. The two chambers are each closed by a respective diaphragm (9) connected to an electric coil (12) for causing the diaphragm to oscillate in coaction with a magnetic unit (14–16), therewith pumping the fluid.

18 Claims, 2 Drawing Sheets

DIAPHRAGM PUMP

BACKGROUND OF THE INVENTION

The present invention relates to a diaphragm pump. This type of pump is particularly intended for use with analysis instruments, although it can also be used in other fields of application which have corresponding pump requirements.

DESCRIPTION OF THE RELATED ART

In respiratory care, pumps are used in conjunction with gas analysis to draw a small flow of sample gas on the patient circuit to an adjacent analysis instrument for analysis. In this case, the pump shall generate a sample flow rate normally in the order of 50–200 ml/min. A pump used in this connection is required to be highly reliable and highly efficient, to have a small size and a low price and to generate only small pulsations with respect to rate of flow, and only small vibrations. It shall also be possible to control the rate of flow through the pump, regardless of pump orientation.

Mainly three types of pumps have been used together with analysis instruments of the aforesaid kind, namely diaphragm pumps, piston pumps and lamella pumps.

A diaphragm pump is based on a construction in which one of the walls of a chamber consists of a moveable diaphragm. The pressure in the chamber can be caused to oscillate, by actuating the diaphragm with the aid of an oscillating lever arm, for instance. The oscillating pressure can be caused to generate a pulsating flow, by providing the chamber with two one-way valves, check valves. In the most common type of diaphragm pump, the type used in aquariums, the oscillating movement is generated with the aid of an electromagnet or solenoid which is powered by alternating current and actuates a lever arm fitted with a permanent magnet. Although this type of diaphragm pump is highly reliable, it has low efficiency. Furthermore, the pump is relatively large and has a low price. Furthermore, this type of diaphragm pump generates relatively large pulsations with respect to flow rate, and also generates heavy vibrations.

The piston pump will normally include an electric motor which drives a piston working in a chamber, through the medium of an eccentric. The chamber is provided with two one-way valves, so as to enable a pulsating flow to be generated. The most serious drawback with the piston pump is that the load on the motor varies over one revolution, meaning that wear on the motor bearings is uneven. Consequently, motors of very high quality are required in order to obtain a satisfactory length of life in respect of this kind of pump. In summary, the piston pump is characterized by low reliability, high efficiency, a relatively small size, a high price, relatively large flow pulsations, and small vibrations.

Lamella pumps are based on a rotor that includes a plurality of lamellae. The rotor is positioned in a circular chamber that includes a conveniently placed inlet and outlet passage-way, and a pulsating flow can be generated as the rotor rotates. The function of the pump is based on sealing contact of the lamellae with the chamber walls as the rotor rotates, in which lies the greatest weakness of this type of pump owing to the fact that the lamellae become worn as a result of the friction against the chamber walls. However, this type of pump has the advantage of being able to generate flows that pulsate less than the flows relating to the two afore-mentioned types of pump. The lamella pump is characterised by low reliability, high efficiency, a relatively small size, a high price, small flow pulsations and small vibrations.

SUMMARY OF THE INVENTION

An object of the present invention is to provide a pump that combines the desirable characteristic features of the afore-described types of pump but does not have the their drawbacks.

This object is achieved with an inventive double-acting diaphragm pump in which two symmetrically positioned diaphragms are caused to oscillate through the influence of two counter-directional electric coils.

In the case of an inventive diaphragm pump that includes components that move about a symmetry plane, there is obtained a pump that will generate only extremely low vibrations and thereby obviate the need for separate vibration damping means, therewith resulting in lower costs and also in smaller space requirements.

BRIEF DESCRIPTION OF THE DRAWINGS

The invention will now be described with reference to a non-limiting exemplifying embodiment and also with reference to the accompanying drawings, in which.

DESCRIPTION OF THE PREFERRED EMBODIMENTS

Figure 1:
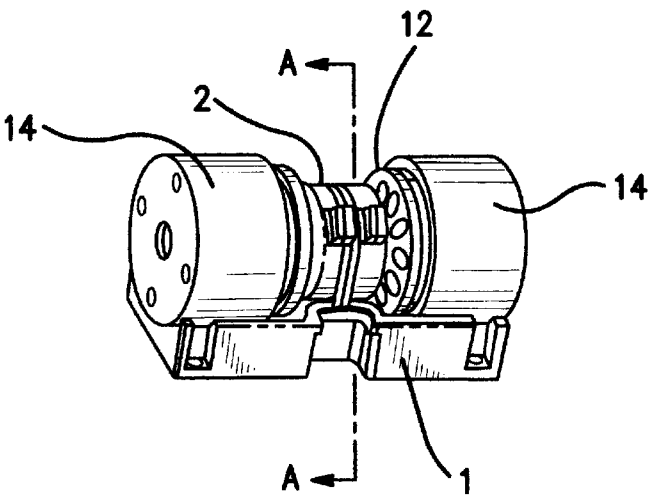
FIG. 1 is a perspective view of an inventive diaphragm pump.

The inventive diaphragm pump shown in FIG. 1 is a double-acting diaphragm pump that is fastened to a fixed unit 1. The two parts of the diaphragm pump, each being in principle an independent pump, have mutually the same construction around a centre plane A—A, although in mirror image with one another.

Figure 2:
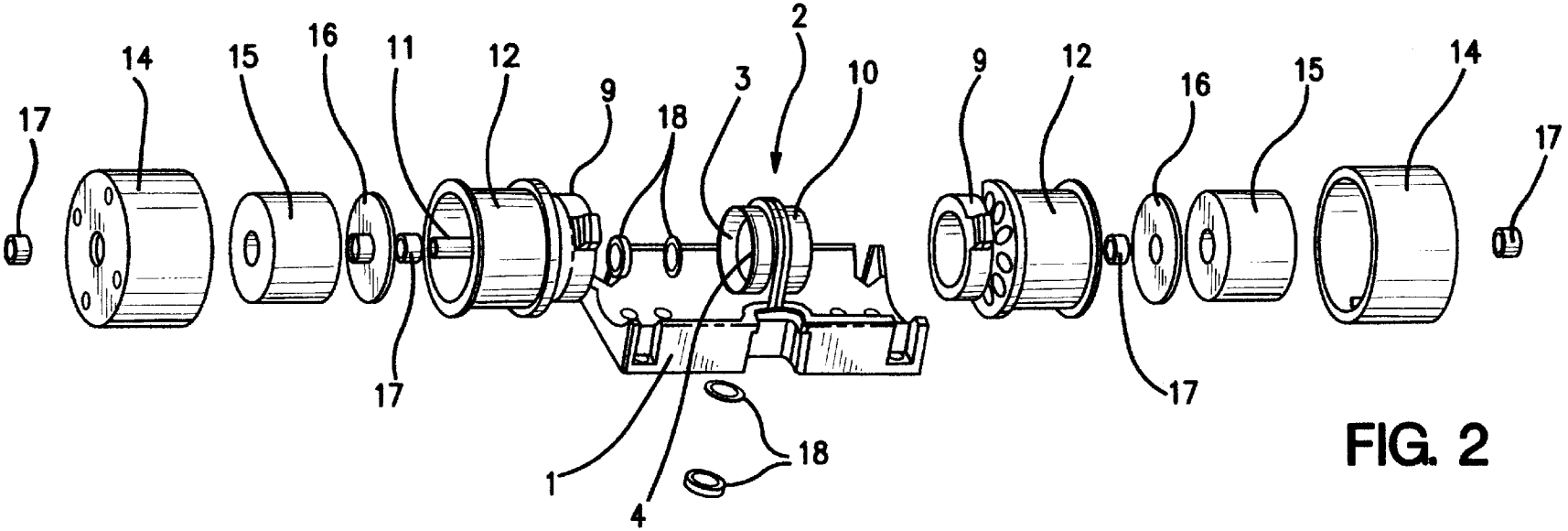
FIG. 2 is an exploded view of the same diaphragm pump, showing the most important components of said pump.
Figure 3:
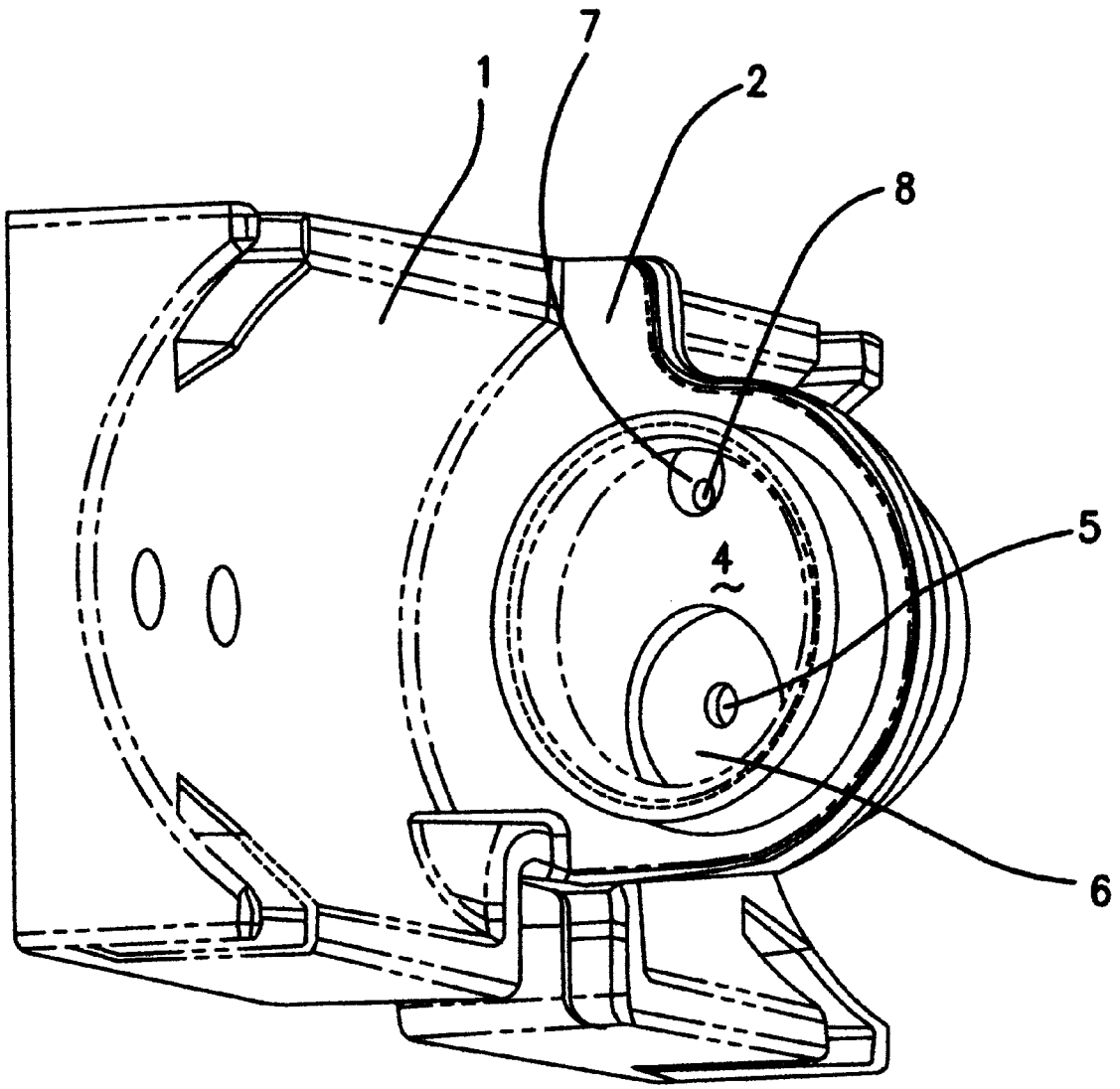
FIG. 3 is a perspective view of the pump housing of the inventive diaphragm pump integrated with a fixed unit.

As will be seen from the exploded view in FIG. 2, a pump housing 2 is positioned centrally in the diaphragm pump. The pump housing includes connections for both fluid supply and fluid exhaust lines. The pump housing 2 is intended to be fixed in the unit 1, and therewith fasten the whole of the pump to said unit. The pump housing 2 includes two chambers 3 formed on respective sides of a partition wall 4. The partition wall 4 includes an inlet passageway that extends parallel with the partition wall 4 out to the bottom of the pump housing 2 and discharges into a transverse opening 5 (FIG. 3), connected to one of said two chambers 3. Located adjacent the transverse opening 5 is a larger radial recess 6 in which a check valve can be accommodated. Also passing through the partition wall 4 is a further transverse passageway 7 which interconnects the two chambers 3. Extending from the transverse passageway 7 is an exhaust line 8, which passes within the partition wall 4 and opens out at the bottom of the pump housing 2 for further connection, via said fastening unit 1, to the person supplied by the pump. Located at the bottom of the pump housing 2 adjacent the outlet orifice of the exhaust line 8 is a radial recess (not shown) corresponding to the radial recess 6 adjacent the transverse orifice 5 of the supply line, this further radial recess being able to accommodate a check valve. FIG. 2 illustrates schematically at 18 components from which a simple check valve can be constructed for use in the pump housing of the inventive diaphragm pump.

A diaphragm 9 is connected to each of the two chambers 3 in the pump housing 2. These diaphragms 9 have the form of a cap which can be fastened securely over the cylindrical outer walls 10 of the pump housing 2, so as to define closed chambers 3 between diaphragm 9, partition wall 4 and the outer wall 10. The diaphragm 9 has axially in the centre of the surface that is situated proximal to the partition wall 4 an opening by means of which the diaphragm can be connected to a shaft 11 and a coil 12 on the outside of said diaphragm 9 (as seen from the chamber) with the aid of an annular washer fitted on the inside of the diaphragm. The connection between the washer and the coil 12/shaft 11 is such as to seal the diaphragm at said opening. The coil 12 is preferably a simple and light moving coil or speech coil. The diaphragm 9, the shaft 11, the coil 12 and the washer together form a diaphragm unit that comprises the only moveable part of the pump.

Movement, i.e. oscillation, of the diaphragm unit is achieved with the aid of a magnetic unit that actuates the coil 12 and therewith sets-up motion in the whole of the diaphragm unit. This magnetic unit includes a cup 14 that surrounds a permanent magnet 15 and a plate 16, with a circular interspace between said plate and said cup. A strong field gradient is generated in this circular interspace, when current is supplied to the windings of the coil 12 via conductors, not shown. The parts 14–16 of the magnetic unit are provided with a central axially through-penetrating hole, and bearings 17 are provided at the ends of the through-penetrating hole in the diaphragm unit for guiding the shaft 11 as it moves axially in response to diaphragm movement.

When the diaphragm pump is fully assembled, the fastener plate 1 constitutes the main body of the pump and is connected to the remaining equipment, and is also provided with supply and exhaust connections. The pump housing 2 is thus secured in the centre of the fastener unit 1, with a diaphragm unit 9, 11, 12 and a magnetic unit 14, 15, 16 on each side of the pump housing. The magnetic units 14–16 are also secured to the fastener unit 1. When the magnetic units are mounted in position, part of the coil 12 of the diaphragm unit will project into the circular interspace between plate 16 and cup 14 in respective magnetic units. The shaft 11 is then also situated in the through-penetrating hole in the magnetic unit.

When the diaphragm unit is caused to move, oscillate, by supplying current to the coil, it is thus only the actual diaphragm unit consisting of the diaphragm 9, the shaft 11, the coil 12 and the washer that moves. The moveable mass in the pump is therefore very small and the vibrations generated will thus also be small. Furthermore, since the pump has two diaphragm units that move in mutually opposite directions about a symmetry plane, the risk of vibrations is further reduced. Moreover, the mass will move solely in an axial direction, meaning that the vibrations will be so small as to completely obviate the need for separate vibration damping means. The efficiency of the inventive pump is also higher than the efficiency of a typical diaphragm pump. As a result of designing the diaphragm units in the aforedescribed way, the diaphragms are caused to both "pull" and "push". The inventive design of the diaphragm units also enables the oscillatory circuit to be optimised more easily.

The improved optimising possibilities allow the resonance frequency of the oscillatory circuit to be chosen relatively arbitrarily, and to enable the characteristics of the pump to be controlled within wide limits. Small flux variations are made possible by selecting a relatively high resonance frequency (e.g. 100 Hz). Furthermore, by selecting a relatively flat efficiency curve around the resonance frequency, low Q-value, stable and unit-independent performances are made possible. This is a significant advantage, as different models of traditional diaphragm pumps normally have greatly varying performances as a result of mutually different resonance frequencies.

The symmetrically constructed pump enables an essentially constant mass centre to be obtained regardless of load, which in combination with the fact that oscillations take place solely in an axial direction has enabled the vibrations generated by an inventive pump to be brought down to a level which renders unnecessary the use of separate vibration damping means, as earlier mentioned. These reasons enable the pump to be made smaller, simpler and cheaper.

As mentioned in the introduction, the inventive diaphragm pump has been developed with the purpose of satisfying a special requirement within medical gas analysis. It will be understood, however, that the diaphragm pump can be used within other fields that have corresponding pump requirements.

What is claimed is:

1. A diaphragm pump, comprising:

a pump housing having an inlet and an outlet for the fluid to be pumped, characterized in that the pump housing (2) includes a partition wall (4) which delimits two chambers (3) on a respective side of the partition wall, said two chambers are each closed by a respective diaphragm (9) connected to an electric coil (12) for causing the diaphragm to oscillate in coaction with a magnetic unit (14–16), therewith pumping said fluid, and a central axially through-penetrating hole centrally located in the magnetic unit provides a space for guiding movement of a shaft in response to diaphragm movement.

2. A diaphragm pump according to claim 1, characterised in that the partition wall (4) lies in a symmetry plane in the pump housing (2) with chambers (3) diaphragms (9) and magnetic units (14–16) disposed symmetrically around the partition wall (4).

3. A diaphragm pump according to claim 1, characterised in that the partition wall (4) includes supply and exhaust lines (5, 8) for fluid to and from the chambers (3) respectively.

4. A diaphragm pump according to claim 1, characterised in that the two chambers (3) are interconnected in the pump housing (2) via a transverse passageway (7).

5. A diaphragm pump according to claim 1, characterised in that the magnetic unit includes a permanent magnet (15).

6. A diaphragm pump according to claim 5, characterised in that the permanent magnet (15) is intended to actuate the coil (12) for oscillation of said coil.

7. A diaphragm pump according to claim 1, characterised in that the pump housing (2) with diaphragms (9) and magnetic units (14–16) is mounted on a common attachment unit (1) that includes connections for supply and exhaust lines to and from the pump respectively.

8. The pump of claim 1, wherein said electric coil is a speech coil.

9. A double-acting diaphragm pump, comprising:

a first diaphragm pump unit;

a second diaphragm pump unit; and a pump housing positioned centrally between the two pump units, the two pump units having the same construction and being positioned around a center plane of the pump housing so that the two pump units are in mirror image with one another, the pump housing comprising
cylindrical outer walls,
connections for both fluid supply and fluid exhaust lines,
two chambers formed on respective sides of a partition wall,
the partition wall including an inlet passageway that extends parallel with the partition wall out to a bottom of the pump housing and discharges into a transverse opening connected to one of the two chambers,
a radial recess located adjacent the transverse opening configured to accommodate a check valve,
a further transverse passageway passing through the partition wall and interconnecting the two chambers, and
an exhaust line extending from the transverse passageway and passing within the partition wall to open out at the bottom of the pump housing for further connection,
each pump unit comprising
a diaphragm connected to a respective one of the two chambers in the pump housing,
the diaphragm having the form of a cap fastened over the cylindrical outer walls of the pump housing so as to define a closed chamber between the diaphragm, the partition wall and the outer wall,
a shaft and a coil positioned outside of the diaphragm,
the diaphragm having, axially in a center of a surface situated proximal to the partition wall, an opening,
the shaft and the coil connecting to the diaphragm via the opening,
the diaphragm, the shaft, and the coil together forming a diaphragm unit, the diaphragm unit being the only movable part of the pump, and
a magnetic unit positioned to actuate the coil,
the magnetic unit comprising a cup that surrounds a permanent magnet and a plate, and a circular interspace between the plate and the cup to support a field gradient being generated in the circular interspace when current is supplied to the coil, and
a central axially through-penetrating hole centrally located in the magnetic unit providing a space for guiding movement of the shaft in response to diaphragm movement.

10. The pump of claim 9, wherein said electric coil is a speech coil.

11. The pump of claim 9, wherein a part of the coil projects into the circular interspace between the plate and the cup.

12. The pump of claim 9, wherein the diaphragm unit consists of the diaphragm, the shaft, the coil and a washer, the washer being a movable washer.

13. The pump of claim 12, wherein the diaphragm unit moves only in an axial direction.

14. A double-acting diaphragm pump, comprising:
a pump housing; and
first and second diaphragm pump units having the same construction and being positioned around a center plane of the pump housing so that the two pump units are in mirror image with one another,
the pump housing comprising
cylindrical outer walls,
two chambers formed on respective sides of a partition wall,
each pump unit comprising
a diaphragm connected to a respective one of the two chambers in the pump housing,
a shaft and a coil positioned outside of the diaphragm and connecting to the diaphragm,
the diaphragm, the shaft, and the coil together forming a diaphragm unit, the diaphragm unit being the only movable part of the pump, and
a magnetic unit positioned to actuate the coil,
the magnetic unit comprising
a cup surrounding a permanent magnet and a plate,
a circular interspace between the plate and the cup to support a field gradient being generated in the circular interspace when current is supplied to the coil, and
a central axially through-penetrating hole centrally located in the magnetic unit providing a space for guiding movement of the shaft in response to diaphragm movement.

15. The pump of claim 14, wherein said electric coil is a speech coil.

16. The pump of claim 14, wherein a part of the coil projects into the circular interspace between the plate and the cup.

17. The pump of claim 14, wherein the diaphragm unit consists of the diaphragm, the shaft, the coil and a washer, the washer being a movable washer.

18. The pump of claim 17, wherein the diaphragm unit moves only in an axial direction.

* * * * *